US008608278B2

(12) United States Patent
Larson et al.

(10) Patent No.: US 8,608,278 B2
(45) Date of Patent: Dec. 17, 2013

(54) DIRECT MARKING PRINTER HAVING A USER CONFIGURABLE PRINT RESOLUTION

(75) Inventors: James R. Larson, Fairport, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/612,023

(22) Filed: Sep. 12, 2012

(65) Prior Publication Data

US 2013/0010022 A1 Jan. 10, 2013

Related U.S. Application Data

(63) Continuation of application No. 12/725,582, filed on Mar. 17, 2010, now Pat. No. 8,287,081.

(51) Int. Cl.
*B41J 29/393* (2006.01)

(52) U.S. Cl.
USPC ..... 347/19; 347/14; 347/15

(58) Field of Classification Search
USPC ..... 347/9, 12–15, 19, 37, 40–43, 49
See application file for complete search history.

(56) References Cited

U.S. PATENT DOCUMENTS

| | | | | |
|---|---|---|---|---|
| 6,116,716 | A * | 9/2000 | Tajika et al. | 347/19 |
| 6,367,908 | B1 | 4/2002 | Serra et al. | |
| 7,059,698 | B1 | 6/2006 | Marra, III et al. | |
| 2009/0091596 | A1 | 4/2009 | Askeland et al. | |

* cited by examiner

*Primary Examiner* — Juanita D Jackson
(74) *Attorney, Agent, or Firm* — Maginot, Moore & Beck, LLP

(57) ABSTRACT

A printing device can be configured with different numbers of ink colors and ink types to print with a different cross-process direction print resolution for each ink color and ink type. The printing device includes a plurality of printhead arrays with each printhead array being configured to eject ink onto an image receiving surface at a first print resolution in a cross-process direction. Each ink supply in a plurality of ink supplies is configured to provide ink to one printhead array in the plurality of printhead arrays, and a controller is configured to operate the printhead arrays at one of at least two combinations of ink colors and ink types. The controller operates the printhead arrays ejecting a same ink color or a same ink type at a second print resolution in the cross-process direction that is different than the first print resolution.

14 Claims, 5 Drawing Sheets

DIRECT MARKING PRINTER HAVING A USER CONFIGURABLE PRINT RESOLUTION

PRIORITY CLAIM

This document claims priority to U.S. patent application Ser. No. 12/725,582, which was filed on Mar. 17, 2010 and is entitled "Direct Marking Printer Having A User Configurable Print Resolution." The application issued as U.S. Pat. No. 8,287,081 on Oct. 16, 2012.

TECHNICAL FIELD

The process and device described below relate to imaging devices and, more particularly, to inkjet imaging devices.

BACKGROUND

Drop on demand inkjet technology for producing printed images has been employed in products such as printers, multifunction products, plotters, and facsimile machines. Generally, an inkjet image is formed by selectively ejecting ink drops from a plurality of drop generators or inkjets, which are arranged in a printhead, onto an image receiving substrate. For example, the printhead and the image receiving substrate may be moved relative to one other and the inkjets may be controlled to emit ink drops at appropriate times. The timing of the inkjet activation is performed by a printhead controller, which generates firing signals that activate the inkjets to eject ink. The image receiving substrate may be an intermediate image member, such as a print drum or belt, from which the ink image is later transferred to a print medium, such as paper. The image receiving substrate may also be a moving continuous web of print medium or sheets of a print medium onto which the ink drops are directly ejected. The ink ejected from the inkjets may be liquid ink, such as aqueous, solvent, oil based, UV curable ink, or the like, which is stored in containers installed in the printer. Alternatively, the ink may be loaded in a solid or a gel form and delivered to a melting device, which heats the ink to generate liquid ink that is supplied to a printhead.

The number of ink drops ejected onto the image receiving substrate within a defined length is referred to as a print resolution. In general, the print resolution of an ink color is measured in two directions. First, the print resolution may be measured in a process direction, which is parallel to a direction of media travel through the printer. Second, the print resolution may be measured in a cross process direction, which is perpendicular to the process direction and in the plane of the media surface. The print resolution of an ink color as measured in the process direction is configurable with printer software. However, the print resolution of an ink color as measured in the cross process direction is less configurable. Specifically, the cross process direction print resolution may be decreased from a native resolution by ejecting the ink color with less than all of the inkjet ejectors of a printhead, such that less ink droplets are ejected onto the image receiving substrate as measured in the cross process direction. However, in single pass printers, in which the media passes by the printheads only one time, the cross process direction print resolution of known inkjet printers may not be increased above the native resolution because additional inkjet ejectors may not be added to known printheads. For example, if a printhead of an inkjet printer includes a printhead having one hundred fifty inkjet ejectors per inch as measured in the cross process direction, the maximum cross process direction printhead resolution of an image formed in a single pass by the printhead is one hundred fifty ink droplets per inch. Therefore, increased flexibility in the print resolution of inkjet imaging systems is desirable.

SUMMARY

A modular printing device has been developed that may be configured with a different numbers of ink colors and ink types and with a different cross-process direction print resolution for each ink color and ink type. The modular printing device configurable to print with multiple combinations of ink colors and ink types at different print resolutions includes a plurality of printhead arrays, each printhead array being configured to eject ink onto an image receiving surface at a first print resolution in a cross-process direction, a plurality of ink supplies, each ink supply being configured to store ink and to provide ink to one printhead array in the plurality of printhead arrays, and a controller configured to operate the plurality of printhead arrays at one of at least two combinations of ink colors and ink types, each combination identifying an ink color or an ink type to be ejected by each printhead array and the controller operating the printhead arrays ejecting a same ink color or a same ink type at a print resolution in the cross-process direction corresponding to the number of printhead arrays ejecting the same ink color or the same ink type.

A method has been developed for operating a modular printing system with a different numbers of ink colors and ink types, and with a different cross process direction print resolution for each ink color and ink type. The method of operating the modular printing device configured to print with multiple combinations of ink colors and ink types at different print resolutions includes ejecting ink onto an image receiving surface at a first print resolution in a cross-process direction with at least one printhead array of a plurality of printhead arrays, providing ink to the plurality of printhead arrays with a plurality of ink supplies, each ink supply being configured to store ink and to provide ink to one printhead array in the plurality of printhead arrays, operating the plurality of printhead arrays at one of at least two combinations of ink colors and ink types with a controller, each combination identifying an ink color or an ink type to be ejected by each printhead array, and operating the printhead arrays ejecting a same ink color or a same ink type at a print resolution in the cross-process direction corresponding to the number of printhead arrays ejecting the same ink color or the same ink type.

BRIEF DESCRIPTION OF THE FIGURES

The foregoing aspects and other features of the present disclosure are explained in the following description, taken in connection with the accompanying figures.

DETAILED DESCRIPTION

The system and method described herein make reference to a printing system. The term "printing system" refers, for example, to image production devices in general, such as printers, facsimile machines, copiers, and related multi-function products. While the specification describes an inkjet printing system, the apparatus, method, and printing components described herein may be used with any printing system that ejects ink onto an image receiving surface.

Figure 1:
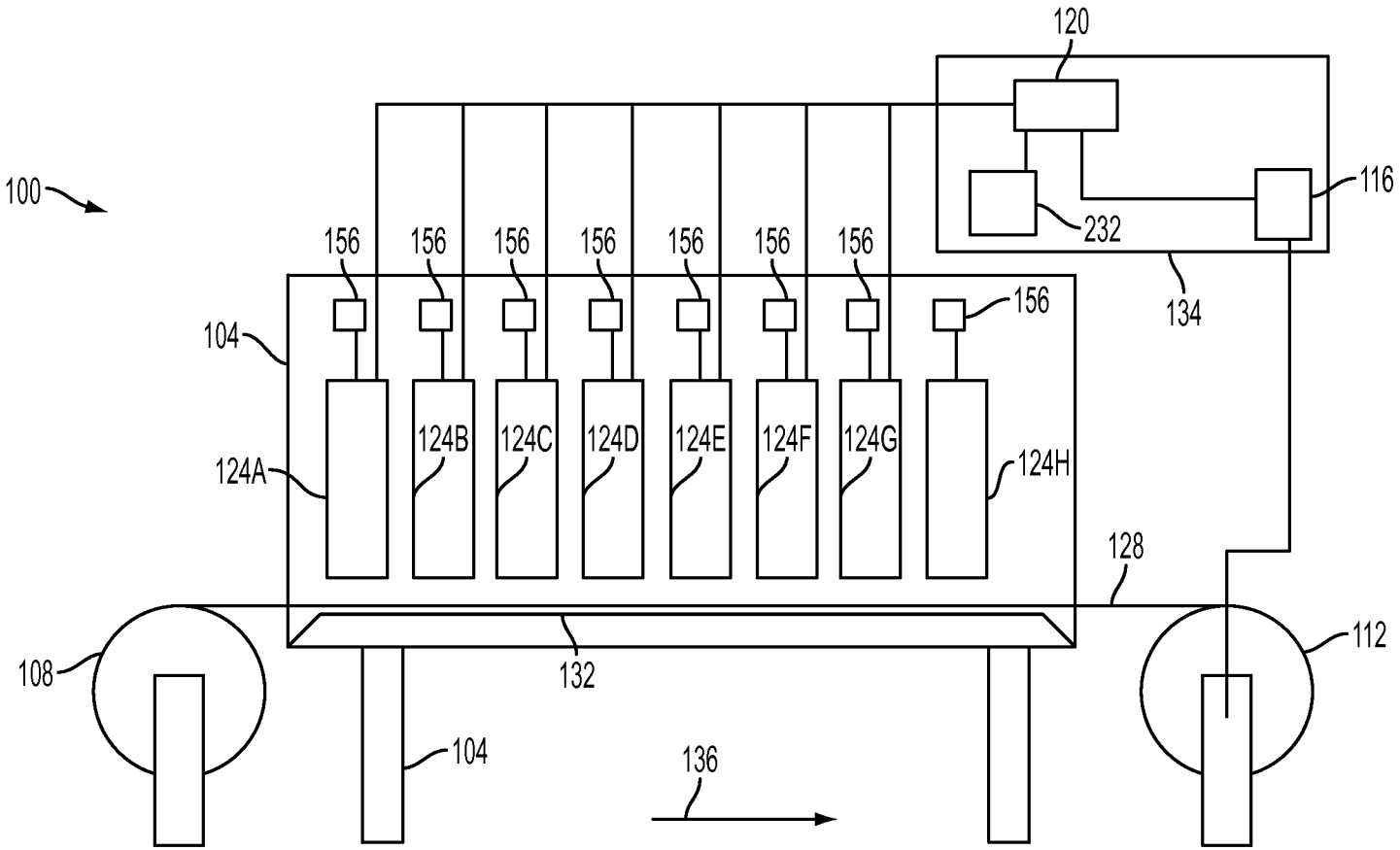
FIG. 1 is a block diagram depicting a side elevational view of a printing system, according to the present disclosure, which includes eight printhead arrays configured to eject ink onto a continuous web of print media.
Figure 5:
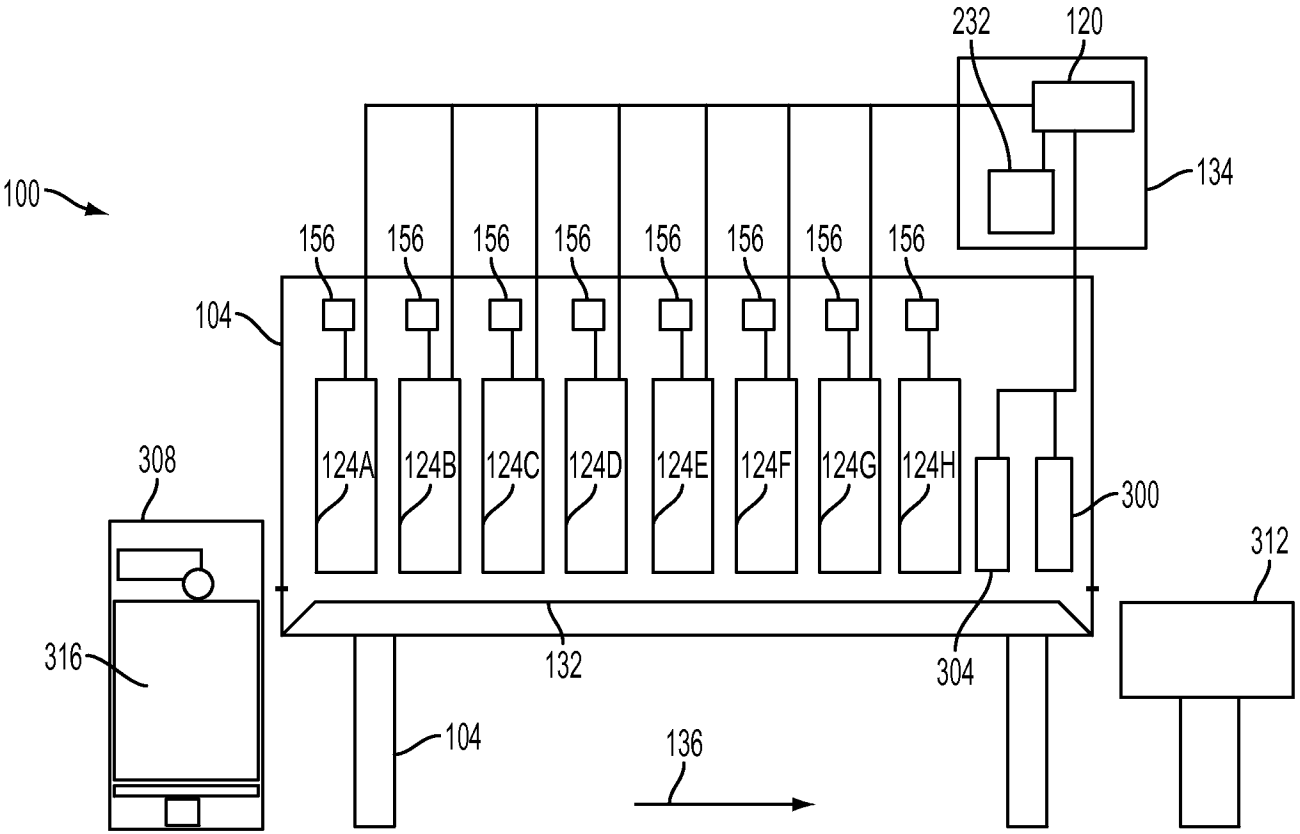
FIG. 5 is a view similar to FIG. 1, but showing the printing system being configured to print curable ink on sheets of print media.

As shown in FIG. 1, a printing system 100 is provided for forming printed images on an image receiving surface. As illustrated, the image receiving surface may be a continuous web of print media, as shown in FIG. 1, or cut sheets of print media, as shown in FIG. 5. Unlike known inkjet printing systems that are limited to a maximum cross process direction print resolution for each ink color and ink type, the printing system 100 enables a user to configure the maximum cross process direction print resolution for each combination of ink color and ink type ejected by the printing system 100.

The printing system 100 of FIG. 1 includes a frame 104, a web supply 108, a rewinder 112, and a component unit 134. The frame 104 includes printhead arrays 124A, 124B, 124C, 124D, 124E, 124F, 124G, 124H (referred to collectively as the printhead arrays 124A-124H) and ink supplies 156. The component unit 134 is electrically coupled to each printhead array 124A-124H. The component unit 134 includes a controller 120, an actuator 116, and an interface 232. The controller 120 is configured to receive electronic image data, to processes the image data with user data received by the interface 232, and to generate firing signal corresponding to the processed image data. In response to receiving the firing signals, the printhead arrays 124A-124H eject ink received from the ink supplies 156 onto a continuous web 128 drawn from the web supply 108. The continuous web 128 moves along a media path 132 in a process direction 136. An actuator 116 drives the rewinder 112 to pull the continuous web 120 through the printing system 100. The printing system 100 is not limited to the exemplary continuous web 128 drive system shown in FIG. 1; accordingly, other systems and devices may be used to move the continuous web 128, or other print media, through the printing system 100.

The printing system 100 is configurable to print images with one of numerous ink compositions. Exemplary ink compositions include, but are not limited to, phase change inks, gel based inks, curable inks, aqueous inks, and solvent inks. As used herein, an ink composition encompasses all ink colors and ink types of a particular ink composition including, but not limited to, usable color sets of an ink composition, gamut extender colors, and spot colors. For example, an ink composition may refer to a usable color set of phase change ink that includes cyan, magenta, yellow, and black inks. Therefore, as defined herein, cyan phase change ink and magenta phase change ink are different ink colors of the same ink composition. Similarly, an ink composition may also refer to an ink type such as an overcoat, varnish, or clear coat that is applied on top of an image formed on the continuous web 128 or a sheet of print media. Additionally, an ink composition may refer to an ink type such as a surface preparation, including, but not limited to, base coats and undercoats, that prepare the print media to receive additional ink. The term "ink composition" includes inks of all colors and types having magnetic or other reactive properties. For example, a particular subset of an ink composition may have magnetic properties, which may be used, for among other purposes, to verify the authenticity of a printed document, such as a bank check in a magnetic ink character recognition ("MICR") system.

The printing system 100 may include one or more printhead arrays 124A-124H configured to eject phase change ink. As used herein, the term "phase change ink", also referred to as "solid ink", encompasses inks colors and types of ink that remain in a solid phase at an ambient temperature and that melt into a liquid phase when heated above a threshold temperature, referred to as a melt temperature. In particular, the term "phase change" includes usable color sets of phase change ink as well as overcoats, varnishes, and surface preparations of phase change ink. When phase change ink cools below the threshold temperature the ink returns to the solid phase. The viscosity of phase change ink in the solid phase is greater than the viscosity of phase change ink in the liquid phase. For example, the viscosity of phase change ink in the solid phase may be approximately six orders of magnitude greater than the viscosity of phase change ink in the liquid phase. Phase change ink is ejected onto an image receiving surface, such as the continuous web 128, in the liquid phase. The ambient temperature is the temperature of the air surrounding the printing system 100; however, the ambient temperature may be a room temperature when the printing system 100 is positioned in a defined space. The ambient temperature may deviate from a room temperature at various positions along a media path taken by the print media, including, but not limited to a print zone opposite the printhead arrays 124A-124H, which are described below. An exemplary range of melt temperatures for phase change ink is approximately seventy to one hundred forty degrees Celsius; however, the melt temperature of some phase change inks may be above or below the exemplary temperature range. Phase change inks are also described in, for example, U.S. Pat. No. 7,407,539 and U.S. Pat. No. 7,377,971.

The printing system 100 is also configurable to form printed images with gel ink. The terms "gel ink" and "gel based ink", as used herein, encompass all ink colors and ink types that remain in a gelatinous state at the ambient temperature and that may be heated or otherwise altered to have a different viscosity suitable for ejection by a printhead array 124A-124H. In particular, the term "gel ink" includes usable color sets of gel ink as well as ink types such as overcoats, varnishes, and surface preparations of gel ink. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty to fifty degrees Celsius; however, the gelation temperature of some gel inks may be above or below the exemplary temperature range. The viscosity of gel ink increases when the ink cools below the gelation temperature.

Some ink compositions, referred to herein as curable inks, are cured during the printing process. As used herein, the process of "curing" ink refers to curable compounds in an ink undergoing an increase in molecular weight upon exposure to radiation, such as by crosslinking, chain lengthening, or the like. Cured ink is suitable for document distribution, is resistant to smudging, and may be handled by a user. Radiation curable ink becomes cured after being exposed to a source of radiation. Radiation suitable to cure ink may encompass the full frequency (or wavelength) spectrum including, but not limited to, visible, ultraviolet, and electron beam radiation, which is commonly referred to as "e-beam" radiation. In particular, ultraviolet-curable ink, referred to herein as UV ink, becomes cured after being exposed to ultraviolet radiation. As used herein, the term "ultraviolet" encompasses the range of wavelengths of light from approximately two hundred nanometers to approximately four hundred nanometers Curable ink may be configured in a gel form. In particular, ultraviolet-curable gel ink, referred to in this document as UV gel ink, is a gelatinous UV ink that is heated to transition the ink to a liquid form for jetting onto an image receiving surface and later exposed to UV radiation to cure the ink (see the curing device 300 of FIG. 5). One advantage of UV gel ink is the return of the ink to the gelatinous state once the ink lands on the image receiving surface. The gelling of the ink retards the absorption of the ink by the image receiving surface to enable the ink to be overprinted with ink from subsequent printhead arrays 124A-124H. UV inks that are not gel inks require a pinning lamp to be mounted to the frame 104 to retard the absorption of the ink by the image receiving surface sufficiently to enable overprinting by subsequent printhead arrays 124A-124H. Ultraviolet gel ink is described in U.S. Pat. No. 7,632,546; U.S. Pat. No. 7,625,956; and U.S. Pat. No. 7,501,015.

The composition, color, and type of the liquid ink ejected by the printing system 100 is user configurable. In particular, the printing system 100 may be user configured to eject a first ink composition for a first print job and a second ink composition for a second print job. For example, at the conclusion of the first print job, the ink source 156 and a corresponding printhead array 124A-124H may be purged of the first ink composition before being filled with the second ink composition Additionally, the printing system 100 may be user configured to eject a first combination of ink colors and/or ink types for a first print job and a second combination of ink colors and/or ink types for second print job, by purging the inks of the first combination following the first print job and filling the ink sources 156 with the inks of the second combination prior to the second print job. Furthermore, one or more ink sources 156 and printhead arrays 124A-124H may be dismounted from the frame 104 and other ink source(s) and printhead arrays 124A-124H may be mounted to the frame 104 to change the ink color or ink type of a particular ink combination. Each printhead array 124A-124H may be configured to eject a different ink color, each printhead array may be configured to eject the same ink color, or at least one printhead array may eject an ink color ejected by at least one other printhead array.

One or more printhead arrays 124A-124H of the printing system 100 may be configured to eject ink types including overcoats, a gamut extender colors, or a spot colors. Suitable results are achievable by ejecting these ink types with only a single printhead array 124A-124H. The overcoat ink or varnish may be coupled to the last printhead array 124A-124H in the series of printhead arrays to ensure that the overcoat is deposited over each ink ejected onto the print media. The gamut extender color is used to increase the subset of colors producible by the printing system 100. Exemplary gamut extender colors include, but are not limited to, red, green, and blue. A gamut extender color may be ejected by any one of the printhead arrays 124A-124H. The spot color is often, but not always, used in conjunction with a second ink color, such as black, to emphasize, or otherwise call attention to a certain portion or portions of the image. The spot color may be ejected onto the print media by any one of the printhead arrays 124A-124H. Overcoats, gamut extenders, and spot colors are not always required to be ejected onto the print media at the maximum achievable cross process direction print resolution; therefore, ejecting an overcoat, gamut extender, or spot color with a single printhead array 124A-124H delivers suitable results.

The frame 104 defines a media path 132 having a profile that is suited to the printing system components that are mounted to the frame 104. As used herein, "printing system component" means a device that ejects ink onto an image receiving surface or that processes ink on an image receiving surface to form ink patterns on the image receiving surface. Printing system components include, but are not limited to, printhead arrays 124A-124H, ink spreading devices 304 (FIG. 5), ink curing devices 300 (FIG. 5), image receiving surface imaging devices (not illustrated), transfix rollers (not illustrated), and the like. In the illustrated embodiments, the frame 104 defines a media path 132 that is generally horizontal. Alternatively, the frame may define a media path 132 having an inclined portion and a declined portion that meet at an apex to give the frame 104 and the media path 132 a generally A-shape profile. The media path 132 extends up the inclined portion 148 and down the declined portion 152 in the process direction.

The frame 104 may be configured to accept any number of printhead arrays 124A-124H. In particular, as illustrated in FIG. 1, the frame 104 includes eight printhead arrays 124A-124H. Alternatively, the printing system 100 may include a different number of printhead arrays 124A-124H. For example a printing system configured to print full color images with cyan, magenta, yellow, and black ink colors may include as few as four printhead arrays 124A-124H.

Each printhead array 124A-124H may be removed from the frame 104 and replaced with a replacement printhead array. The replacement printhead array may eject an ink color or ink type different than the printhead array 124A-124H removed from the frame 104. Thus, the composition, color, or type of the liquid ink ejected by the printing system 100 may be user configured by removing a printhead array 124A-124H configured to eject ink of a first composition, color, or type and coupling to the frame 104 a replacement printhead array configured to eject ink of a second composition, color, or type.

The printhead arrays 124A-124H eject liquid ink contained by the ink sources 156 onto the print media, as the print media moves in a process direction 136 through the printing system 100. The term "liquid ink" as used herein, includes, but is not limited to, aqueous inks, liquid ink emulsions, pigmented inks, phase change inks in the liquid phase, and gel inks having been heated or otherwise treated to alter the viscosity of the ink for improved jetting. The printhead arrays 124A-124H may be configured to eject ink onto the print media in any of a plurality of directions, including generally vertical and generally horizontal. The printhead arrays 124A-124H depicted in FIG. 1 eject ink in a vertical direction.

Figure 2:
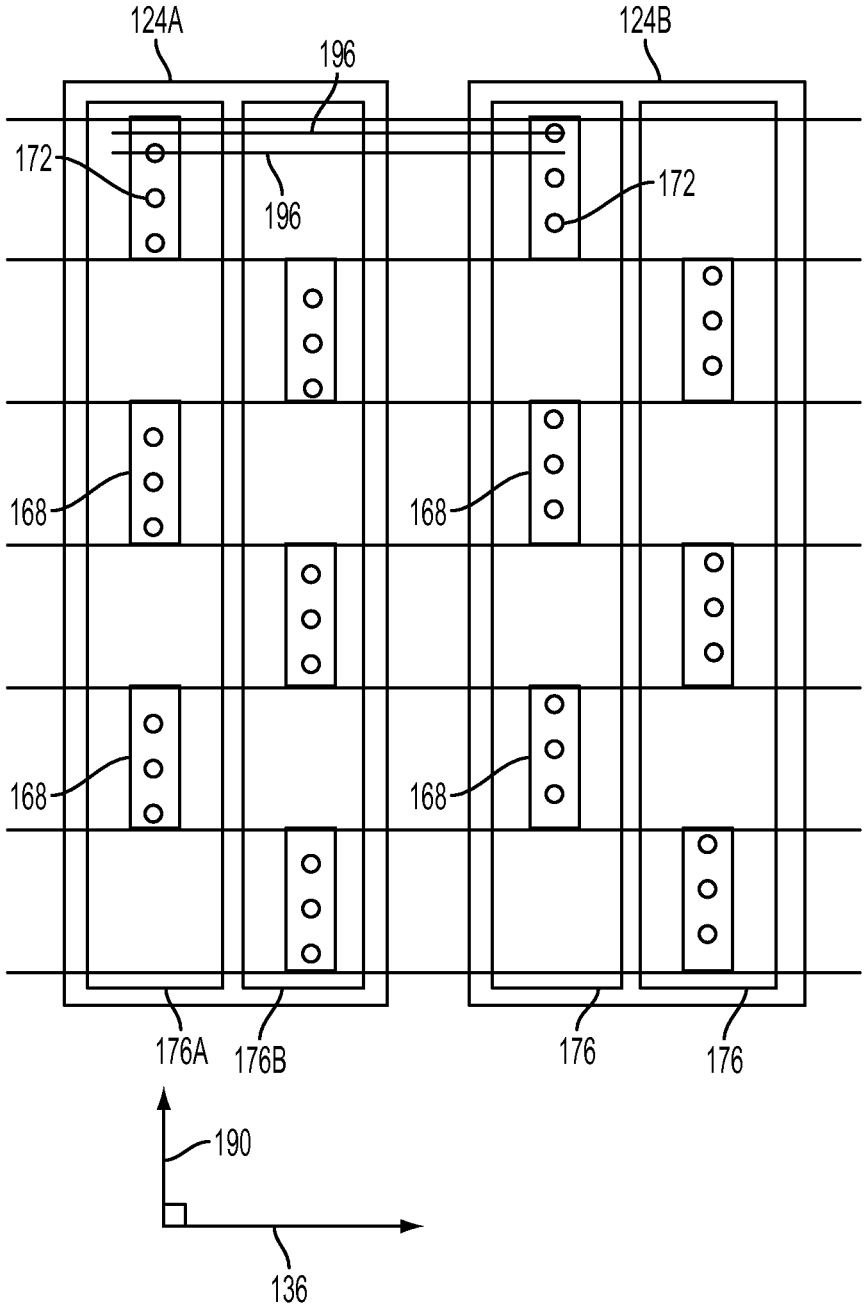
FIG. 2 is a block diagram depicting a bottom-view of two printhead arrays of the printing system of FIG. 1, each printhead array including two print bars having staggered printheads.

As shown in FIG. 2, a printhead array 124A-124H may include two print bars 176 each having numerous printheads 168 and nozzles 172. Ink droplets are ejected through the nozzles 172 and onto the print media. The printheads 168 of the print bar 176A are staggered with the printheads 168 of the print bar 176B, such that a continuous region of ink droplets may be ejected across the width of the print media as measured in the cross process direction 190. The staggered printheads 168 of a print array 124A-124H form the equivalent of a single printhead having a consistent and uniform cross process print resolution. Alternatively, each printhead array 124A-124H may include a single print bar 176 having a single printhead that extends across the entire width of the print media. Alternatively, there are other configurations of printheads 168, common to those of ordinary skill in the art, for creating a contiguous printhead array 124A-124H out of individual printheads 168, including utilizing three or more print bars 176, as well as angling multiple printheads 168 in a "sawtooth" pattern.

The nozzles 172 are openings in the printhead 168 through which ink droplets are expelled from the print bar 176. A nozzle 172 may have a diameter or width of approximately twenty micrometers (20 μm) to forty micrometers (40 μm). For simplicity, the illustrated printheads 168 include three nozzles 172, each having a greatly enlarged diameter. A printhead 168 may include between five hundred (500) to nine hundred (900) nozzles 172 positioned within an approximately rectangular region. Each nozzle 172 is fluidly coupled to an inkjet ejector (not illustrated), which propels the ink droplets from the nozzle 172 in response to receiving a firing signal from the controller 120. The inkjet ejectors may be thermal inkjet ejectors, piezoelectric inkjet ejectors, mechanical capacitive inkjet ejectors, or other types of continuous inkjet ejectors, known to those of ordinary skill in the art.

The position of each printhead array 124A-124H may be adjusted in the cross process direction. Specifically, the position of each printhead array 124A-124H may be independently adjusted with respect to the position of each other printhead array. The adjustable position of the printhead arrays 124A-124H enables each printhead array to eject ink droplets between the ink droplets ejected by any other printhead array and/or any other group of printhead arrays. As shown in FIG. 2, the nozzles 172 of the printhead array 124A may be staggered with respect to the nozzles 172 of the printhead array 124B, as shown by lines 196 of FIG. 2. Therefore, the ink droplets ejected onto the print media by the printhead array 124A are interlaced with the ink droplets ejected onto the print media by the printhead array 124B.

The adjustable position of the printhead arrays 124A-124H enables the printing system 100 to eject each ink color of a combination of ink colors with a configurable cross process direction print resolution. The term "print resolution", as used herein, refers to the number of ink droplets ejected onto the continuous web 128 within a defined length in either the process direction 136 or the cross process direction 190. Print resolution is often measured in dots per inch ("dpi"). For example, a printing system 100 having a print resolution of three hundred dpi is capable of ejecting three hundred ink droplets onto an image receiving surface within one linear inch. As used herein, a process direction print resolution may be defined as the number of ink droplets ejected onto the continuous web 128 within a defined length that is approximately parallel to the process direction 136. The cross process direction print resolution may be defined as the number of ink droplets ejected on the continuous web 128 within a defined length that is approximately parallel to the cross process direction 190.

The process direction print resolution of an ink color or ink type ejected by a printhead array 124A-124H is determined by the web speed, the frequency of the firing signals, and/or the number of nozzles 172 per unit length measured in the process direction 136, among other characteristics of the printing system 100. The process direction print resolution can be configured by changing any one or more of the aforementioned characteristics of the printing system via the controller 120. For example, the process direction print resolution of an ink color may be increased by reducing the web speed and/or by increasing the frequency of the firing signals. Alternatively, the process direction print resolution may be decreased by increasing the web speed and/or by decreasing the frequency of the firing signals. In one embodiment, each printhead array 124A-124H is configured to eject ink droplets with the same process direction print resolution. In another embodiment, however, a first printhead array 124A-124H ejects ink droplets with a process direction print resolution that is different from the process direction print resolution of the ink droplets ejected by at least one other printhead array. For example, the first printhead array 124A-124H may receive firing signals at a frequency greater than or less than the frequency of the firing signals received by at least one other printhead array.

The cross process direction print resolution of an ink color is related to the number of nozzles 172 as measured in the cross process direction that are configured to eject the ink color or ink type. The maximum cross process direction print resolution, referred to as the base or native resolution, of a printhead array 124A-124H is determined by the number of nozzles 172 per unit length of the printheads 168 as measured in the cross process direction.

The cross process direction print resolution of an ink color or ink type ejected by a printhead array 124A-124H may be reduced below the native resolution by ejecting the ink color or ink type through less than all of the nozzles 172 of the printhead array.

The cross process direction print resolution of an ink color or ink type may be increased above the native resolution by ejecting the ink color or ink type with more than one printhead array 124A-124H, each of which having been positioned properly. As shown in FIG. 2, the nozzles 172 of the printhead array 124A are positioned to eject ink droplets between the ink droplets ejected by the nozzles 172 of the printhead array 124B. This position is referred to as a "staggered" arrangement of printhead arrays 124A-124H. Accordingly, the print resolution of the ink color ejected by the printhead array 124A combines with the print resolution of the ink color ejected by the printhead array 124B such that the resultant cross process direction print resolution of an ink color ejected by both printhead arrays 124A, 124B may be as great as twice the native resolution of the printhead arrays 124A, 124B. For example, if each printhead array 124A, 124B includes three hundred (300) nozzles 172 per inch in the cross process direction 190, the combined maximum cross process direction print resolution of an ink color ejected by both printhead arrays 124A, 124B is six hundred (600) dpi. Although only two printhead arrays 124A, 124B are shown in an interlaced position in FIG. 2, any number of printhead arrays may be positioned to eject ink droplets between the ink droplets ejected by each other printhead array. Therefore, if each printhead array 124A-124H of the printing system of FIG. 1 includes three hundred nozzles 172 per inch in the cross process direction 190, the combined maximum cross process direction print resolution of an ink color ejected by all the printhead arrays 124A-124H is two thousand four hundred dpi. Accordingly, if each printhead array 124A-124H has the same native resolution, then a total cross process direction print resolution of a group of staggered printhead arrays may be determined by multiplying the native resolution by the number of printhead arrays in the staggered group of printhead arrays. In general, the printhead arrays 124A-124H that are configured to eject different ink colors or ink types are not staggered.

Each printhead array 124A-124H may include a hardware set that operates independently of each other printhead array. The independent hardware set may include a printhead controller (not illustrated) mechanically mounted to the printhead array 124A-124H and electrically connected the inkjet ejectors of the printhead array. Accordingly, the printhead controller of a printhead array 124A-124H having an independent hardware set may receive image data directly from an image data source or from the controller 120. The printhead controller of the independent hardware set generates firing signals that are sent to the ink ejectors of the printhead array 124A-124H to which the printhead controller is connected.

The controller 120 generates firing signal for each of the printhead arrays 124A-124H based in part on the desired resolution of each ink color. The controller 120 is configured with input/output ("I/O") circuitry, memory, programmed instructions, and other electronic components to process the image data and generate firing signals, among other functions. The controller 120 may be a self-contained, dedicated computer having a central processing unit ("CPU"), electronic data storage, and a display or user interface ("UI"). The controller 120 may be implemented with general or specialized programmable processors or sub-controllers that execute programmed instructions. The instructions and data required to perform the programmed functions may be stored in memory associated with the processors or the sub-controllers. The processors, their memories, and interface circuitry configure the controller 120 to perform the processes, which generate the firing signals to enable the printhead arrays 124A-124H to eject ink droplets onto the continuous web 128 in a pattern that forms an image represented by the image data. The components of the controller 120 may be provided on a printed circuit card or provided as a circuit in an application specific integrated circuit ("ASIC"). Each of the circuits may be implemented with a separate processor or multiple circuits may be implemented on the same processor. Alternatively, the circuits may be implemented with discrete components or circuits provided in very large scale integration ("VLSI") circuits. Also, the circuits described herein may be implemented with a combination of processors, ASICs, discrete components, or VLSI circuits.

Each printhead array 124A-124H may be digitally addressable within the printing system 100 to enable the controller 120 and external devices connected to the printing system 100 to send data to a specific printhead array and to receive data from a specific printhead array 124. In particular, each printhead array 124A-124H may have a digital address different from each other printhead array in the printing system 100. Additionally or alternatively, each printhead 168 may include a digital address that is different from each other printhead 168 within the printing system 100. In each embodiment, a unique digital address may enable the controller 120 to send firing signals to a particular printhead array 124A-124H or printhead 168 on a data bus to which each printhead array and/or printhead 168 is connected. Additionally, components of the printing system 100 having a digital address may be connected to an electronic network to send data to and/or to receive data from a device external to the printing system 100. Exemplary external devices that may be connected to the printing system 100 include personal computers and imaging devices. External devices may be electrically connected to the printing system 100 via a wired connection, a wireless connection, a local area network, and/or a wide area network including the Internet.

The controller 120 receives cross process direction print resolution data for each ink color and each ink type after the printhead arrays 124A-124H have been positioned to achieve a desired cross process direction print resolution for each ink color and ink type. The controller 120 determines a combined print resolution for each ink color and ink type supplied to the printhead arrays 124A-124H. To this end, the controller 120 may receive from each printhead array 124A-124H a print resolution signal. The print resolution signal indicates to the controller 120 the maximum cross process direction print resolution of each printhead array 124A-124H. The print resolution signal may also indicate to the controller 120, a range of suitable process direction print resolutions of each printhead array 124A-124H, and a firing signal frequency range. Each printhead array 124A-124H may include an electronic memory (not illustrated) that stores the print resolution data of each printhead array. The controller 120 may identify the print resolution data of each printhead array 124A-124H by accessing the electronic memory of each printhead array.

The controller 120 may also receive the maximum cross process direction print resolution for each ink color and each ink type via an interface referred to as an input data module 232. The input data module 232 receives user data, which includes, but is not limited to, print resolution data, ink color data, and ink composition data. The input data module 232 is any type of input device that is configured to receive user data, such as a keypad or keyboard and the like. The input module 232 may include a graphical user interface to indicate to a user the current configuration status of the printing system 100 and also to confirm that the user data has been correctly received by the input module 232. The input data module 232 generates the print resolution signal and the ink color signal from the user data. Thereafter, the input data module 232 transmits the print resolution signal and the ink color signal to the controller 120. Accordingly, embodiments of the printing system 100 having an input data module 232 may not require the controller 120 to receive from the printhead arrays 124A-124H the print resolution signal and the ink color signal.

The controller 120 may also receive the maximum cross process direction print resolution for each ink color and each ink type through an updated programming process. In particular, a user may reprogram software stored in the memory of the controller 120 to correspond to the desired arrangement and configuration of the printing system 100.

Figure 3:
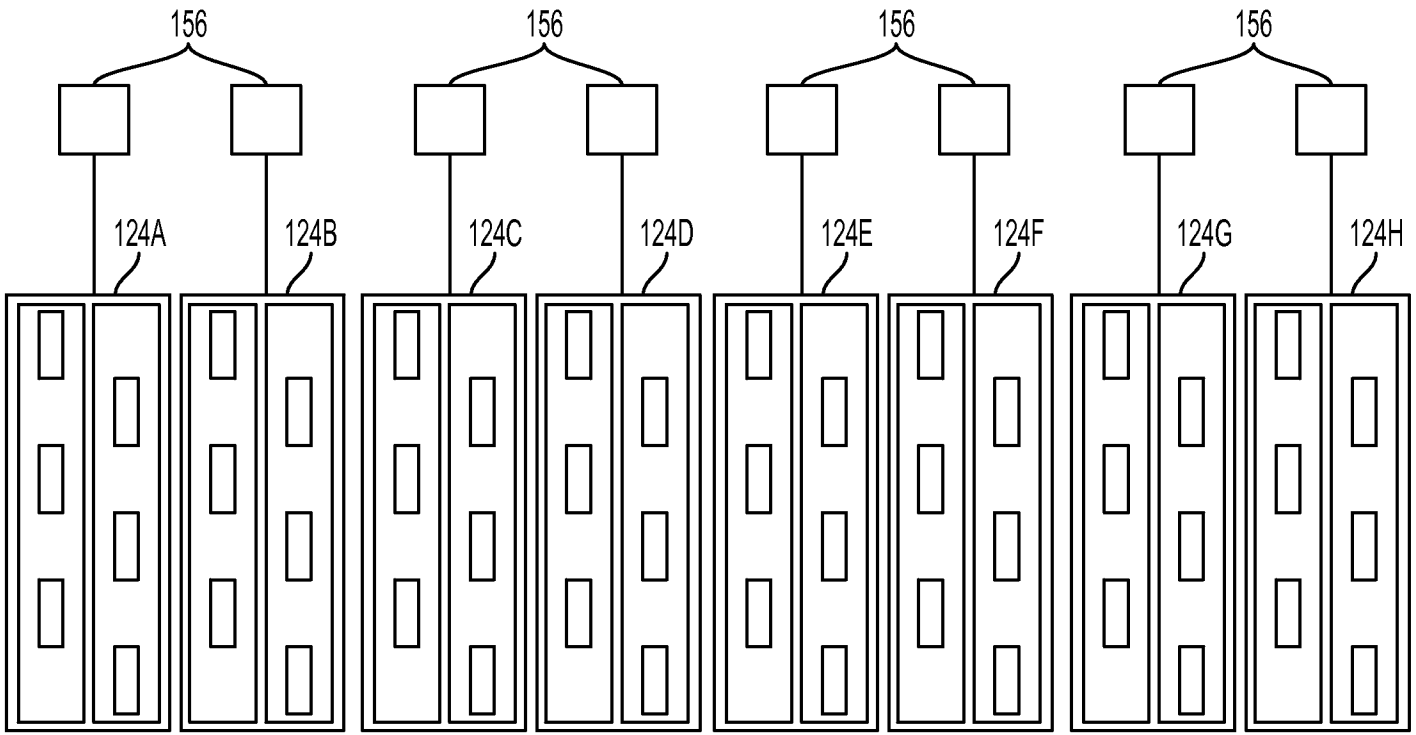
FIG. 3 is a block diagram depicting a bottom-view of each printhead array of FIG. 1.

An exemplary data set corresponding to the maximum cross process direction print resolution for each ink color and each ink type of the printhead arrays 124A-124H of FIG. 3 may contain the following information. The printhead arrays 124A, 124B, and 124C being arranged in a staggered arrangement for an increased cross process direction print resolution, the printhead arrays 124A, 124B, and 124C being configured to eject a first ink color. The printhead arrays 124D and 124E being arranged in a staggered arrangement for an increased cross process direction print resolution, the printhead arrays 124D and 124E being configured to eject a second ink color. The printhead array 124F being configured to eject a third ink color. The printhead arrays 124G and 124H being arranged in a staggered arrangement for an increased cross process direction print resolution, the printhead arrays 124G and 124H being configured to eject a fourth ink color. The controller 120 operates the groups of printhead arrays 124A-124H configured to eject the same ink color or ink type at a print resolution in the cross-process direction corresponding to the number of printhead arrays ejecting the same ink color or the same ink type.

The controller 120 generates firings signals that cause the printhead arrays 124A-124H to eject ink droplets in a pattern, which forms an image represented by the image data. The controller 120 may receive image data directly from an image data generator, such as, but not limited to, a personal computer, an imaging device, or an electronic memory. As used herein, the term "image data" includes all electronic data representations an image or a portion of an image. The controller 120 includes software to process the image data. As used herein, the term "processing" image data refers to rendering image data and generating a sequence of firing signals. The controller 120 processes the image data with respect to the print resolution information and the ink color/type information of the printhead arrays 124A-124H. In particular, if a cross process direction print resolution of an ink color is three hundred (300) dpi the controller 120 does not attempt to eject the ink color onto the continuous web 128 at a cross process direction print resolution greater than three hundred (300) dpi.

Figure 4:
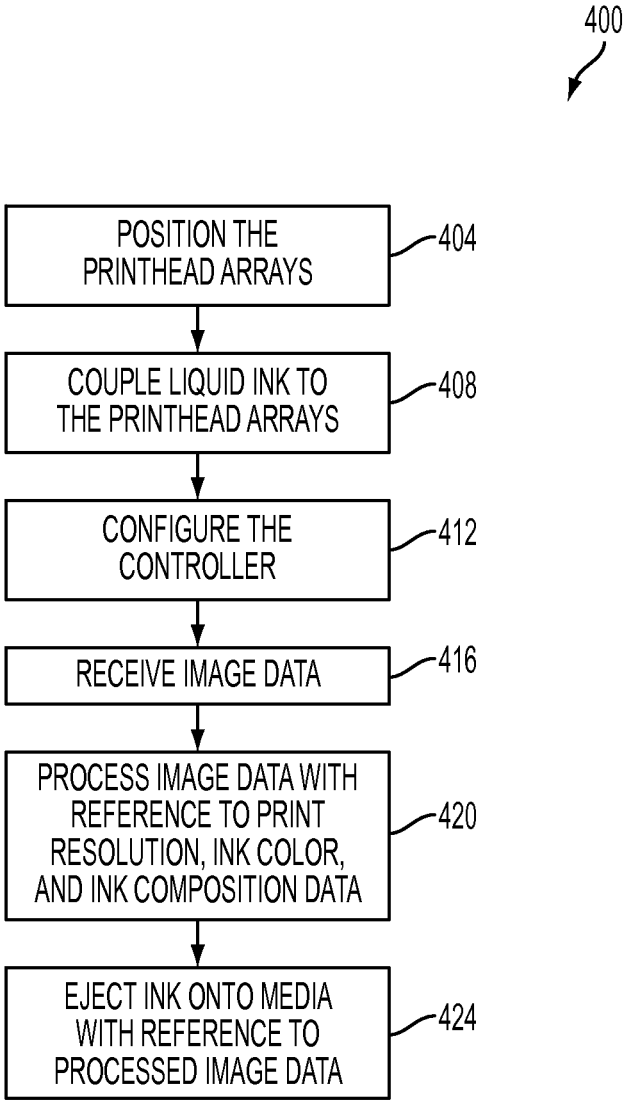
FIG. 4 is a flowchart illustrating a process for operating the printing system of FIG. 1.

An exemplary method of configuring and operating the printing system 100 is depicted by the process 400 of FIG. 4. As shown in FIG. 4, the process 400 with positioning the printhead arrays 124A-124H (block 404). In particular, each group of two or more printhead arrays 124A-124H that are configured to eject the same ink color or ink type may be positioned in the staggered arrangement, as described above. Positioning a printhead array 124A-124H refers to moving the printhead array in the cross process direction 190 to enable the ink droplets ejected by the positioned printhead array to be interlaced with the ink droplets ejected by the other printhead arrays configured to eject the same ink color. Two or more printhead arrays 124A-124H may be positioned in response to the image data requiring the printing system 100 to eject an ink color with a cross process direction print resolution greater than the native resolution of any one printhead array. The printing system 100 may print a test pattern to aid a user in determining if the printhead arrays 124A-124H are aligned as described above.

After the printhead arrays 124A-124H are positioned, the ink sources 156 are fluidly coupled to the printhead arrays (block 408). In one embodiment, an ink source 156 may be fluidly coupled to a printhead array 124A-124H by connecting a flexible ink line or other type of conduit to an ink input of a printhead in a printhead array.

Next, the controller 120 is configured to receive a print resolution of each printhead array 124A-124H and an ink color and composition of each ink source 156 fluidly coupled to a printhead array (block 412). In one embodiment, the controller 120 may receive from each printhead array 124A-124H a print resolution signal that identifies the maximum cross process direction print resolution of each printhead array, and an ink signal that identifies the ink color and composition fluidly coupled to each printhead array. Alternatively, the controller 120 may receive the print resolution signal and the ink signal from the input data module 232. The input data module 232 may include a keyboard or other device upon which a user may enter user data corresponding to the print resolution of each printhead array 124A-124H and the ink color and composition coupled to each printhead array.

The controller 120 receives the image data either before or after the controller 120 receives the print resolution signal and the ink signal (block 416). The controller 120 processes the image data with reference to the print resolution information and the ink color/type information received from the input data module 232 (block 420). That is, a color separation processing may be performed with reference to a maximum print resolution identified for each ink color and ink type, based in part on the number of printhead arrays 124A-124H configured to eject each ink color and ink type. Software programmed into an electronic memory housed within the controller 120 performs this image data processing and generates a series of firing signals that correspond to the processed data. The firing signals are electrically coupled to the inkjet ejectors in the printhead 168 of the printhead arrays 124A-124H to eject ink onto the continuous web 128 in a pattern that corresponds to the image data. A different series of firing signals may be sent to each printhead array 124A-124H required to form the image. In response to receiving the firing signals, the ink ejectors eject ink onto the print media, which may be a continuous web 128 or sheets of print media, to form the printed image (block 424).

In response to each printhead array 124A-124H of the printing system of FIG. 1 being configured to eject a different in color or type, an ink mass density may be reduced below a suitable level. The ink mass density, as the term is used herein, refers to the amount of ink ejected onto the print media per unit area. The ink mass density may be increased, by decreasing the print media speed and/or increasing the frequency of the firing signals. Increasing the ink mass density compensates for a decreased cross process direction print resolution by ejecting a greater quantity of ink onto the print media; however, an asymmetry between the cross process direction print resolution and the process direction print resolution may still remain. When three or more printhead arrays 124A-124H each eject the same ink color or ink type, the speed of the print media may be increased without reducing the ink mass density to an unsuitable level. The level of the ink mass density is maintained, because three or more printhead arrays 124A-124H may be configured to eject more ink per unit time onto the print media than two printhead arrays.

Ejecting an ink color with more than one printhead array 124A-124H bolsters the printing system 100 against non-firing inkjet ejectors and/or clogged nozzles 172. A non-firing inkjet ejector is an inkjet ejector that does not eject an ink droplet after receiving a firing signal. A clogged nozzle 172 is a nozzle 172 that prevents a corresponding inkjet ejector from ejecting an ink droplet. The controller 120 may be configured to compensate for non-firing inkjet ejectors and/or clogged nozzles 172 by sending an appropriately timed firing signal to a functional inkjet ejector located near the non-firing inkjet ejector. In particular, a line approximately parallel to the process direction 136 may extend through, or nearly through, the non-firing inkjet ejector/clogged nozzle 172 and the compensating inkjet ejector/nozzle 172.

As shown in FIG. 5, the printing system 100 may be configured to print images with a curable ink on cut sheets of print media. The printing system 100 of FIG. 5 includes an ink curing assembly 300, an ink spreader 304, an input media tray 308, and an output media tray 312. The curing assembly 300 may be mounted to the frame 104 subsequent to the printhead arrays 124A-124H to cure the ink ejected onto the print media by each printhead array. The curing assembly 300 may also be coupled to other portions of the frame 140 configured for selective mounting of a printing system component. The curing assembly 300 is positioned along the media path 132 to cure the ink ejected onto the print media before the ejected ink contacts any of a series of rollers (not illustrated), which guide the print media along the media path 132. The curing assembly 300 may expose the ink to ultraviolet radiation to cure the ink. The curing assembly 300 may be mounted to the frame 104 of FIG. 1 to cure curable ink ejected onto the continuous web 128.

The ink spreader 304 is configured to spread ink droplets ejected onto the print media into a substantially continuous area without physically contacting the ink droplets. When ink droplets contact the print media there may be a space between each ink droplet and a plurality of surrounding ink droplets. The ink spreader 304 flattens the ink droplets such that each ink droplet contacts one or more adjacent ink droplets to form a continuous area of ink. The ink spreader 304 is commonly used to spread gel ink; however, the ink spreader is not limited to spreading only gel ink. The ink spreader 304 may expose the ink to infrared radiation to spread the ink without contacting the ink. The ink spreader 304 may be mounted to the frame 104 of FIG. 1 to spread ink droplets ejected onto the continuous web 128. Alternatively, the ink spreader 304 may be a contact type ink spreader through which the media passes, such as a pair of nip forming rollers that apply pressure to the ink/media combination to spread the ink droplets.

The input media tray 308 is positioned near an input of the media path 132. The input media tray 308 strips individual sheets of print media from a print media supply 316. The media path 132 receives the sheets of print media stripped from the supply 316. A media transport system (not illustrated) transports the print media along the media path 132 to receive ink from the printhead arrays 124A-124H.

The output media tray 312 is positioned near an output of the media path 132. The output media tray 312 receives the print media sheets having an image formed thereon.

The printing system 100 has been described as a direct printing system; however, the printing system may also be an indirect printing system. As the term is used herein, a "direct" printing system is a printing system 100 in which the inkjet ejectors of the printhead arrays 124A-124H eject ink directly onto a print media. An "indirect" printing system, as the term is used herein, is a printing system 100 in which the printhead arrays 124A-124H eject ink onto an intermediate surface. The ink ejected onto the intermediate surface is transferred from the intermediate surface to a print media such as the continuous web 128. The intermediate surface may be a drum, belt, band, platen, or any other surface suitable for receiving ink and transferring ink to a print media. For example, the intermediate surface may include one or more rotatably mounted drums. Each drum receives ink from one or more printhead arrays 124A-124H and transfers the ink to the print media, which is configured to contact the rotating drum as the print media moves along the media path 132.

The printing system 100 may be a single pass or a multi-pass printing system. In a single pass printing system, all of the ink colors and/or ink types of an image are developed with a single pass of the print media through the printing system. For example, as shown in FIG. 5, a media sheet may be stripped from the input media tray 308, transported on the media path 132 to receive ink from the printhead arrays 124A-124H, and deposited in the output media tray 312. The ink received from the printhead arrays 124A-124H in the single pass along the media path 132 completes the image to be formed on the print media. A single pass printing system may print images on sheets of print media or a continuous web of print media. In a multi-pass printing system one or more ink colors and/or ink types are developed in multiple separate passes through the printing system. For example, as shown in FIG. 5, a media sheet may be stripped from the input media tray 308 and transported on the media path 132 to receive ink from the printhead arrays 124A-124H. Next, the media sheet having ink already thereon, is transported at least once more on the media path 132 to receive additional ink from the printhead arrays 124A-124H. A multi-pass printing system may print images on sheets of print media or on a continuous web of print media.

Those skilled in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen and/or unappreciated, and that, for example, may arise from applicants, patentees, and others.

What is claimed is:

1. A printing device configurable to print with multiple combinations of ink colors and ink types at different print resolutions comprising:

a plurality of printhead arrays, each printhead array being configured to eject ink onto a surface of an image receiving member at a first print resolution in a cross-process direction;

a plurality of ink supplies, each ink supply being configured to store ink and to provide ink to one printhead array in the plurality of printhead arrays; and a controller configured to operate the plurality of printhead arrays at one of at least two combinations of ink colors and ink types, each combination identifying an ink color or an ink type to be ejected by each printhead array and the controller operating the printhead arrays ejecting a same ink color or a same ink type to print at a second print resolution in the cross-process direction that is different than the first print resolution in the cross-process direction.

2. The printing device of claim 1, the controller being further configured to control a speed of the image receiving member to eject ink onto the image receiving member at a predetermined resolution in a process direction.

3. The printing device of claim 1, wherein the second print resolution in the cross-process direction corresponds to the number of printhead arrays ejecting the same ink color or the same ink type.

4. The printing device of claim 1, the controller being further configured to:

operate the printhead arrays to form a printed image on the surface of the image receiving member in a single pass of the surface of the image receiving member, and the image receiving member is a continuous web of print media.

5. The printing device of claim 1, the controller being further configured to:

operate the printhead arrays to form a printed image on the surface of the image receiving member in a single pass of the image receiving surface, and the image receiving member is a sheet of print media.

6. The printing device of claim 1, the controller being further configured to:

operate the printhead arrays to form a printed image on the surface of the image receiving member in at least two passes of the image receiving member, and the image receiving member is a continuous web of print media.

7. The printing device of claim 1, the controller being further configured to:

operate the printhead arrays to form a printed image on the surface of the image receiving member in at least two passes of the image receiving surface, and the image receiving member is a sheet of print media.

8. A method of operating a printing device configured to print with multiple combinations of ink colors and ink types at different print resolutions, the method comprising:

ejecting ink onto a surface of an image receiving member at a first print resolution in a cross-process direction with at least one printhead array of a plurality of printhead arrays;

providing ink to the plurality of printhead arrays with a plurality of ink supplies, each ink supply being configured to store ink and to provide ink to one printhead array in the plurality of printhead arrays;

operating with a controller the plurality of printhead arrays at one of at least two combinations of ink colors and ink types, each combination of ink colors and ink types identifying an ink color or an ink type to be ejected by each printhead array; and operating with the controller the printhead arrays ejecting a same ink color or a same ink type to print at a second print resolution in the cross-process direction that is different than the first print resolution in the cross-process direction.

9. The method of operating a printing device of claim 8 further comprising:

controlling a speed of the image receiving member with the controller to eject ink onto the image receiving member at a predetermined print resolution in a process direction.

10. The method of operating a modular printing device of claim 8 wherein the second print resolution in the cross-process direction corresponds to the number of printhead arrays ejecting the same ink color or the same ink type.

11. The method of operating a modular printing device of claim 8 further comprising:

operating the printhead arrays to form a printed image on the surface of the image receiving member in a single pass of the surface of the image receiving member, and the image receiving member is a continuous web of print media.

12. The method of operating a modular printing device of claim 8 further comprising:

operating the printhead arrays to form a printed image on the surface of the image receiving member in a single pass of the surface of the image receiving member, and the image receiving member is a sheet of print media.

13. The method of operating a modular printing device of claim 8 further comprising:

operating the printhead arrays to form a printed image on the surface of the image receiving member in at least two passes of the surface of the image receiving member, and the image receiving member is a continuous web of print media.

14. The method of operating a modular printing device of claim 8 further comprising:

operating the printhead arrays to form a printed image on the surface of the image receiving member in at least two passes of the surface of the image receiving member, and the image receiving member is a sheet of print media.

* * * * *